United States Patent [19]

Morawski

[11] 4,121,692

[45] Oct. 24, 1978

[54] LADDER TRAY

[76] Inventor: Janus Morawski, 368 Spadina Rd., Toronto, Canada

[21] Appl. No.: 784,063

[22] Filed: Apr. 4, 1977

[51] Int. Cl.[2] ..... E06C 7/14; E06C 7/48

[52] U.S. Cl. ..... 182/129; 182/214

[58] Field of Search ..... 182/214, 121, 120, 129, 182/107, 108; 248/238

[56] References Cited

U.S. PATENT DOCUMENTS

| | | | |
|---|---|---|---|
| 1,007,347 | 10/1911 | Flightner | 182/214 |
| 2,882,003 | 4/1959 | Stiffler | 182/214 |
| 3,073,414 | 1/1963 | Lavrard | 182/27 |
| 3,318,415 | 5/1967 | Christie | 182/214 |
| 3,693,756 | 9/1972 | Walker | 182/129 |

FOREIGN PATENT DOCUMENTS

| | | | |
|---|---|---|---|
| 1,260,476 | 1/1972 | United Kingdom | 182/214 |

*Primary Examiner*—Reinaldo P. Machado

[57] ABSTRACT

A ladder support for the upper end of a ladder which incorporates a supporting frame member having three sides, and two free ends, the two free ends being attachable to a portion of the ladder, a tray within the frame member, and having through bolt means at the free ends of the frame member for passing completely through a rung of the ladder whereby the two free ends of the supporting frame may be securely bolted to the ladder while permitting a floating action. Supporting leg means extends from the frame at an angle to connect with another portion of the ladder. The invention provides, by use of the through bolt fastening, a degree of flexibility in the attachment of the frame and tray to the ladder which permits a desirable floating action so that the frame may conform to, for example, an irregular or angled surface while providing secure support for the top of the ladder.

3 Claims, 3 Drawing Figures

LADDER TRAY

The present invention relates to a ladder support for attachment to the upper end of a ladder to hold the same away from a wall or working surface, and providing support for tools.

The problems of working on the upper end of a ladder, when the same is resting against a wall is very well known. The workman is standing too close to the wall and must lean away from the ladder in order to have a reasonable view of his work. In addition, the upper end of the ladder is relatively narrow, and any slight sideways movement of the body will create an imbalance tending to make the ladder twist or slide. In addition, there is nothing at the upper end of a ladder for carrying tools.

Many attempts have been made to provide some form of supporting bracket for attachment to the upper end of the ladder for holding the upper end of the ladder away from the wall. However, these devices are not always satisfactory. In particular, ladders may be twenty or thirty feet long and relatively heavy. It is necessary for the workman to move the ladder along the wall. The ladder is also somewhat flexible, and the upper end of the ladder may move up and down on the wall as the workman moves up and down the ladder. On the other hand, it is essential to prevent the ladder from sliding sideways, and any tendency for the ladder supporting device at the upper end of the ladder to permit sideways movement of the ladder while the man is standing on the ladder is highly dangerous.

Such earlier supporting devices were also unsatisfactory in that they could not be satisfactorily attached to the ladder. In the majority of cases they merely provided some form of clamp-like device for clamping over the rungs of the ladder or for gripping on to the side rails of the ladder. While, it is clearly essential that the supporting device should be securely attached to the ladder, it is found to be advantageous to permit some relative movement between the ladder and the supporting device in use, and this has not previously been possible.

In addition to these factors, it is desirable that the ladder supporting device also incorporates some form of tray for supporting tools.

Preferably, in accordance with the invention all or the majority of these factors will be incorporated in a ladder support for the upper end of a ladder which will incorporate a supporting frame member having three sides, and two free ends, the two free ends being attachable to a portion of the ladder, and having through bolt means for passing completely throught the free ends, and through a rung of the ladder, but without snuggly fitting the same whereby the two free ends of the supporting frame may be securely bolted to the ladder, while permitting a floating action.

Leg means are provided from the frame downwardly at an angle to another portion of the ladder and having two free ends engaging opposite sides of the ladder.

Preferably the invention will permit limited movement of the support in response to flexing of the ladder and be able to accommodate different ladders.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 1:
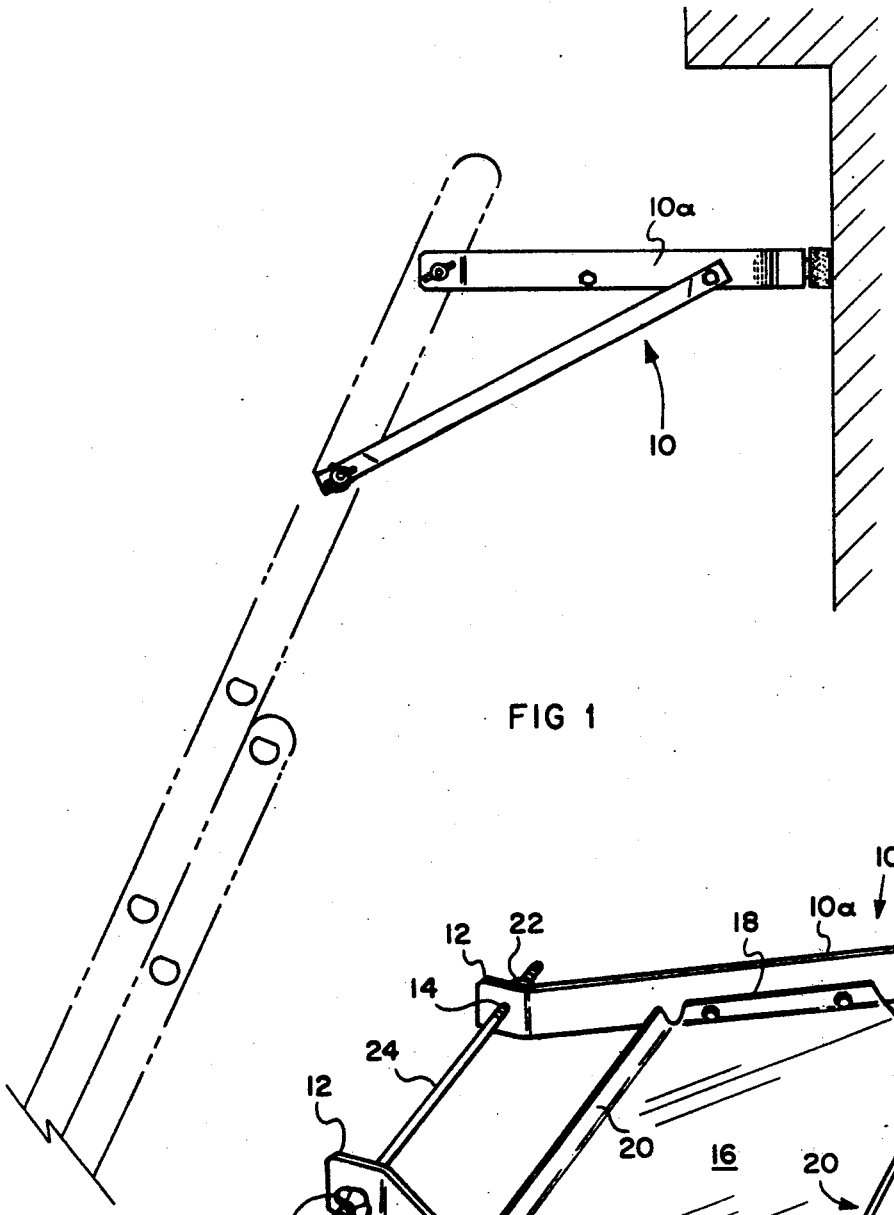
FIG. 1 is an upper perspective illustration of a ladder supporting tray according to the invention.
Figure 2:
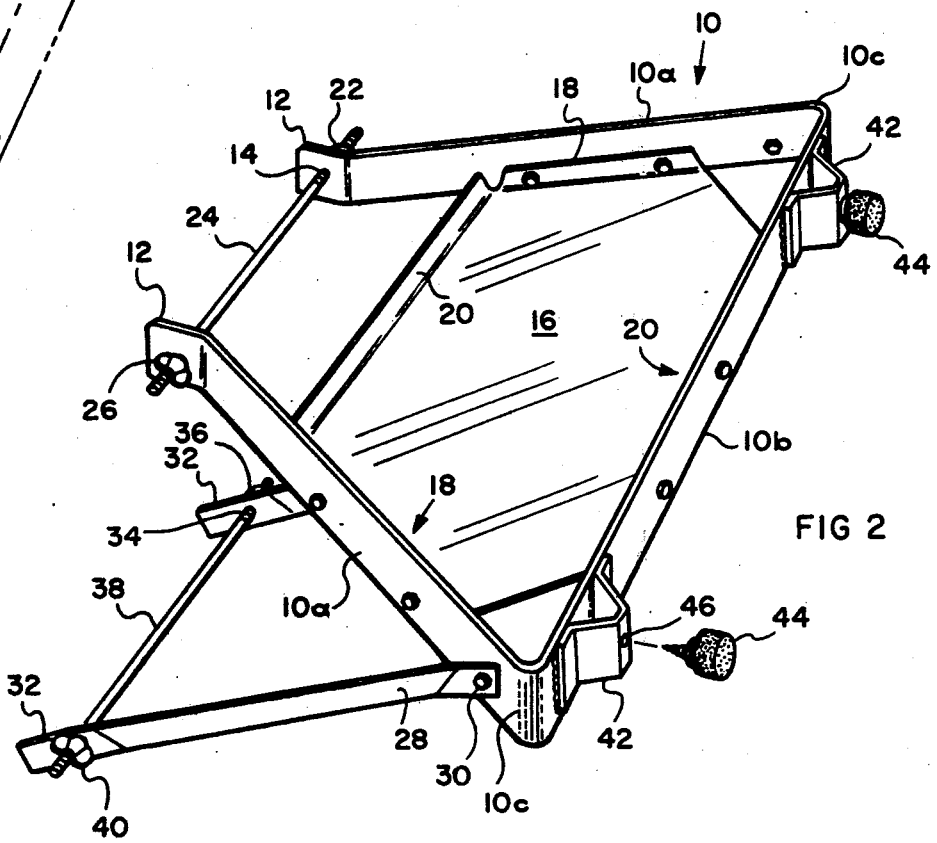
FIG. 2 is a plan view of a detail of FIG. 1.

Referring now to FIGS. 1 and, 2, it will be understood that the invention is to be on an aluminum ladder, in use against a wall. Such ladder typically may be a single or an extension ladder, usually having a frame F of extruded aluminum of which there are many types and sizes available on the market. No further description is therefore required apart from the fact that the rungs R shown in phantom of the ladder are of hollow tubular construction having a round or a D-shaped section, and define through openings extending right through the side frames F of the ladder.

The ladder support according to the invention will be seen to comprise a generally three sided outer frame 10 consisting of two side members 10*a* and a cross member 10*b*. Frame 10 is formed of a single piece of metal strip section, bent into the three sided shape as shown, by corner bends 10*c*. As shown in the drawings the side members 10*a* are angled inwardly from the ends of cross member 10*b*, to about the width of the ladder at their inner ends.

The two free ends 12 are bent into parallel spaced apart planes and holes 14 are provided through the two free ends 12 in registration with one another.

Within the outer frame 10, there is provided a sheet metal tray 16. The tray 16 is bent up along its sides 18 and 20, and is fastened to the portions 10*a* and 10*b* of the frame 10.

A threaded member, e.g. a nut 22, is fastened e.g. by welding, rivetting or the like to one end portion 12, in registration with hole 14.

A through-bolt fastening member 24 extends through the holes 14, and is provided at one end with any suitable form of head e.g. a wing nut 26 fixed on the bolt 24, which may be grasped either manually or with a hand tool and the other end is threaded to engage nut 22. The bolt 24 will typically be of for example $\frac{3}{8}$ inch steel materials, or any other suitable size such that it can easily be passed loosely through a hollow tubular rung of an aluminum ladder. It is not intended that the bolt 24 should in any way make a snug fit in the interior of the rung, and indeed a certain degree of relative movement is intended and is found to be desirable in accordance with the invention. All that is required from the bolt 24 that it should provide a secure fastening of the frame 10 to the upper end of the ladder but permitting a certain degree of free play or looseness.

In order to hold the frame at a fixed angle relative to the ladder, a pair of strut members 28 are attached by bolts 30 to the frame 10. The free ends 32 of the struts 28 have holes 34. A nut 36 is welded or rivetted to one end 32 in registration with hole 34. A through-bolt fastener 38 is provided to extend through holes 34 and is threaded to engage nut 36. Any suitable head, for example, wing nut 40 is fastened non-rotatably on the other end of bolt 38 so that it may be manually rotated to engage nut 36.

Bolt 38 is deliberately made under-size in relation to the interior dimension of the rungs of the ladder so as to provide a degree of free play.

When the tray according to the invention is attached at the upper end of the ladder, with the through bolt 24 passing through one rung, and with the through bolt 38 of struts 28 extending through the next adjacent rung down the ladder, the ladder tray will be securely but loosely fastened to the ladder. The ladder may then be erected against a building for example with the tray resting against the building. As a workman climbs the ladder, the ladder will naturally flex. However, the free play between the ladder and the ladder tray will be such that it can readily accommodate most of such flexing movement without the tray moving against the wall.

In addition, the upper end of the ladder is supported away from the wall so that the workman standing even at the top of the ladder is located in a convienent working position away from the wall. In addition, the tray provides a useful support for tools paint brushes and the like.

In order to improve the engagement between the frame 10 and the wall, a pair of bearing members or legs 42 are fastened to the exterior of the frame portion **10*b* of the frame extending forwardly therefrom, and resilient pads 44 formed of rubber are preferably fastened in any suitable manner on the legs 42 for resiliently engaging the surface of the wall. The pads 44 may be of any suitable material such as rubber or the like and are preferably releaseably fastened in for example holes 46 in the legs 42** so that they may be replaced as they wear out.

Figure 3:
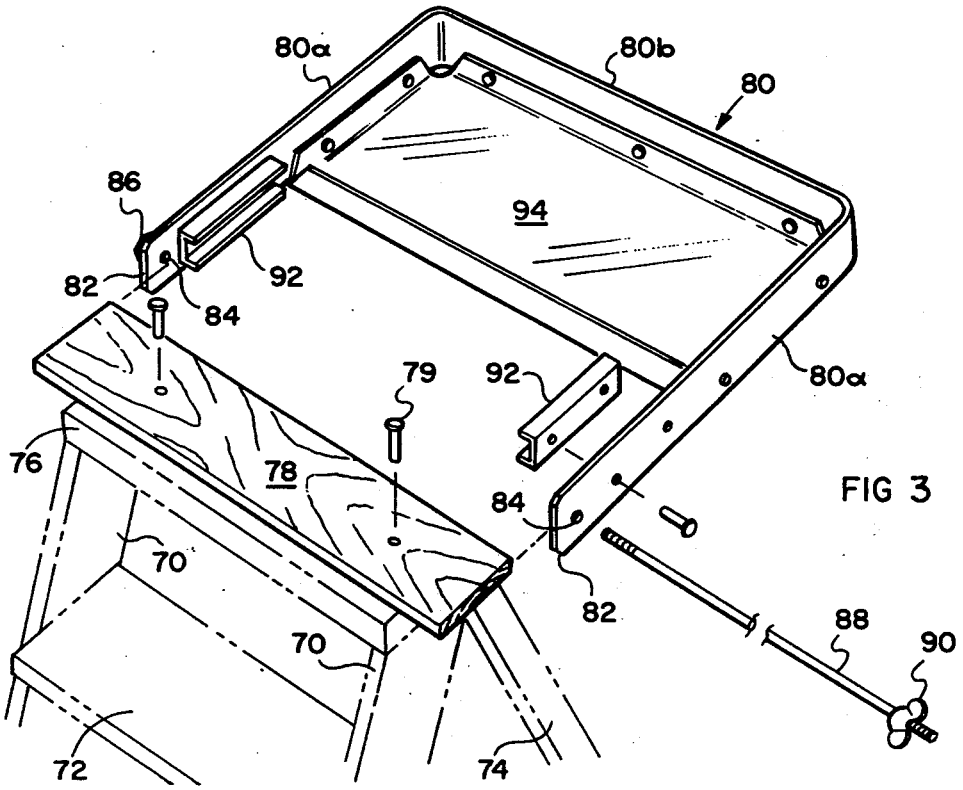
FIG. 3 is an upper perspective of an alternate embodiment.

The invention may also be applied to the conventional household step-ladder, as shown in FIG. 3.

A typical household step-ladder is shown having side frames 70 and steps 72 supported thereon, and a bracing frame 74 swingably mounted to a top step 76.

In this form of household step-ladder, the rungs of the conventional exterior ladder are replaced by the steps 72 which are of course of a different construction, and do not provide through openings through the side frames 70.

Accordingly, an attachment plate 78 is provided according to the invention which in this illustration is simply a rectangular piece of wood, but could equally well be made of metal of the like and is attached by means such as bolts 79 to the top step 76 of the ladder.

The attachment plate 78 has a length dimension greater than the length of the top step 76 so as to extend outwardly from either side thereof.

In accordance with the invention, a frame 80 is provided having side members **80*a* and a cross member 80*b*, and having free ends 82 provided with holes 84**.

A nut 86 is welded on one of the free ends 82 in registration with the hole 84, and a through bolt fastener 88 is provided, having any suitably manually operated head 90 fastened to one end, and threaded at the other.

A pair of channel support members 92 are fastened to the inner surfaces of side members **80*a*, by means such as rivets or the like, and such channel members being arranged lengthwise along the length of the side members 80, spaced a short distance inwardly from the holes 84. The channel members 92 are arranged so that they will fit loosely on the two free ends of the attachment plate 78**.

A tray 94 is fastened between the side members **80*a* and cross member 80*b***, for supporting tools and supplies.

In use, the attachment plate 78 is bolted to the top step 76 of a household step-ladder with its two free ends projecting outwardly from such top step. The channel members 92 are then slid onto the free ends of the attachment plate 78, until the edge of tray 94 abuts against the attachment plate 78, at this point, the holes 84 will just be clear of the opposite side of attachment plate 78 so that the through bolt 88 can be passed through holes 84 and screw threaded into fixed nut 86.

Once the through bolt 88 is fastened, the entire ladder tray is then securely attached to the attachment plate. It will however, be noted that a certain degree of free movement or looseness is again desirable, so that in fact the dimensions of the channels 92 will be such that they make a loose fit on the attachment plate 78 so that a certain degree of looseness or floating action is permissible between the ladder tray and the step-ladder, without permitting the ladder tray to become detached.

Such a ladder tray when applied to a household step-ladder does not interfere with the normal use of the step-ladder with the bracing frame 74 swung outwardly.

However, when it is desired to work closer to a wall, especially in circumstances where the bracing frame 74 is in fact an obstruction, then the ladder may be used with the ladder tray resting against the wall.

It will thus be seen that the invention provides much greater flexiblity in use for such a household step-ladder, and at the same time provides a useful support for tools.

Where the step ladder is itself a wooden ladder, the top steps of the ladder will often be found to be of a size equal to the size of the plate 78. In this case the plate 78 can be discarded, and the channels 92 will fit directly onto such top step.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A ladder support of the type adapted to be attached to the upper end of a ladder having hollow tubular rungs to hold the same away from a wall or the like and comprising;

an integral one-piece supporting frame having a central cross-member and two side members formed integrally from a single length of material, with the side members making acute angles relative to the cross member and converging towards one another from their junction with said cross member;

two free ends on said side members angled relative thereto whereby to lie parallel and spaced apart from one another whereby to receive the upper end of a ladder therebetween and having holes therethrough;

tray means fastened between said cross-member and said side members and supporting the same;

through bolt fastening means at said free ends of said frame for passing completely through said holes and through a said hollow rung and securely fastening said free ends of said frame on either side of said ladder said bolt fastening means being undersize relative to said rung thereby permitting a floating action between the ladder support, and ladder, in use, and, bracing means attached to said frame adapted for connection with said ladder to brace said supporting frame while permitting said floating action.

2. A ladder support as claimed in claim 1 wherein said bracing means comprise a pair of leg members attached on opposite side of said supporting frame, and defining two free ends spaced apart from one another, and including through bolt fastening means extending between said free ends of said leg members, for fastening said free ends of said leg means to said ladder at a point spaced below the attachment of said free ends of said supporting frame.

3. A ladder support for use in association with a stepladder having a top step and comprising;

an integral one piece supporting frame having a central cross member and two side members formed integrally from a single length of material, with the side members angled relative to the cross member;

a generally rectangular attachment plate member releasably attachable to said top step of said step ladder, and defining two free ends;

a pair of channel members fastened on said two side members, in face to face relation with one another, and dimensioned to make a sliding fit on said free ends of said attachment plate members;

tray means fastened between said cross-member and said side members and supporting the same;

through bolt fastening means at said free ends of said side members, located and oriented so as to be fastened between said free ends around said attachment plate.

* * * * *

UNITED STATES PATENT AND TRADEMARK OFFICE

CERTIFICATE OF CORRECTION

PATENT NO. : 4,121,692

DATED : October 24, 1978

INVENTOR(S) : Janusz Morawski

It is certified that error appears in the above—identified patent and that said Letters Patent is hereby corrected as shown below:

On the cover sheet Item (76) Inventor's name should read -- Janusz Morawski --.

Signed and Sealed this

*Twenty-eighth* Day of *October 1980*

[SEAL]

*Attest:*

SIDNEY A. DIAMOND

*Attesting Officer*

*Commissioner of Patents and Trademarks*